US009633501B2

(12) United States Patent
Mitsuyama et al.

(10) Patent No.: US 9,633,501 B2
(45) Date of Patent: Apr. 25, 2017

(54) CASH AUTOMATIC TRANSACTION DEVICE

(71) Applicant: Hitachi-Omron Terminal Solutions, Corp., Tokyo (JP)

(72) Inventors: Toshifumi Mitsuyama, Tokyo (JP); Eisuke Shiomi, Tokyo (JP); Junji Fujita, Tokyo (JP); Masanori Terao, Tokyo (JP)

(73) Assignee: Hitachi-Omron Terminal Solutions, Corp., Tokyo (JP)

( * ) Notice: Subject to any disclaimer, the term of this patent is extended or adjusted under 35 U.S.C. 154(b) by 0 days.

(21) Appl. No.: 15/136,495

(22) Filed: Apr. 22, 2016

(65) Prior Publication Data

US 2016/0358401 A1 Dec. 8, 2016

(30) Foreign Application Priority Data

Jun. 3, 2015 (JP) ..... 2015-113356

(51) Int. Cl.
*G07D 11/00* (2006.01)
*G07F 19/00* (2006.01)
*G07F 7/04* (2006.01)

(52) U.S. Cl.
CPC ..... *G07D 11/0027* (2013.01); *G07D 11/0003* (2013.01); *G07D 11/0018* (2013.01); *G07F 19/202* (2013.01); *G07F 19/203* (2013.01); *G07F 7/04* (2013.01)

(58) Field of Classification Search
CPC .. G07D 11/0018; G07D 11/0027; G07F 7/04; G07F 19/202; G07F 19/203; B65H 2301/31; B65H 2701/1912
USPC ..... 194/206, 207, 344, 351
See application file for complete search history.

(56) References Cited

U.S. PATENT DOCUMENTS 5,547,062 A * 8/1996 Mays ..... B65H 5/38 194/206
2005/0200072 A1* 9/2005 Sawayama ..... B65H 9/06 271/207

FOREIGN PATENT DOCUMENTS

JP 2012-073875 A 4/2012

* cited by examiner

*Primary Examiner* — Mark Beauchaine
(74) *Attorney, Agent, or Firm* — Foley & Lardner LLP

(57) ABSTRACT

A cash automatic transaction device capable of, upon storage of a banknote sent from a depositing/dispensing port in a banknote storage box, or upon accumulation of a banknote sent from the banknote storage box in the depositing/dispensing port, preventing the occurrence of trouble such as paper jam or poor posture. The cash automatic transaction device has a depositing/dispensing port used for depositing/dispensing of banknotes, and a banknote storage box for storage of deposited/dispensed banknotes. The depositing/dispensing port has depositing/dispensing space to store the deposited/dispensed banknotes, and accumulation space in which the banknote is accumulated upon dispensing. The width of the depositing/dispensing space is smaller than the exit and entrance width of the storage box, while the width of the accumulation space is greater than the exit and entrance width of the storage box.

9 Claims, 15 Drawing Sheets

CASH AUTOMATIC TRANSACTION DEVICE

CLAIM OF PRIORITY

The present application claims priority from Japanese application serial no. JP2015-113356, filed on Jun. 3, 2015, the content of which is hereby incorporated by reference into this application.

BACKGROUND OF THE INVENTION

Technical Field

The present invention relates to a cash automatic transaction device.

Background Art

In recent years, regarding a cash automatic transaction device, downsizing of mechanism and increment in the number of storable banknotes for diversification of installation position and improvement in maintainability, and simplification of mechanism for cost reduction, are required. Further, orderly accumulation and storage of banknotes in various sizes by nation/region or by denomination is also required.

Japanese Unexamined Patent Application Publication No. 2012-73875 discloses a cash automatic transaction device having a banknote dispensing port from which a user picks up dispensed banknotes, storage space for storing dispensed banknotes one by one in the banknote dispensing port, a guide member to guide the dispensed banknotes upon storage in the storage space, and a side wall forming the storage space. When the dispensed banknotes are accumulated in the storage space, the guide member is protruded from the side wall. When the dispensed banknotes are discharged, the guide member is stored in the side wall.

The disclosure in Japanese Unexamined Patent Application Publication No. 2012-73875 relates to a unit called a depositing/dispensing port in which banknotes deposited by a user in a paper sheet handling device are putted in and from which banknotes are dispensed to the user. Japanese Unexamined Patent Application Publication No. 2012-73875 discloses a technique to provide a cash automatic transaction device which holds paper sheets in an orderly arrayed state while preventing falling of the paper sheets. Further, the cash automatic transaction device has a depositing/dispensing port protected from entrance of foreign materials without any disturbance of transaction by the user.

The cash automatic transaction device is provided with a reflux box to store banknotes transferred from the depositing/dispensing port upon depositing and to discharge the banknotes to the depositing/dispensing port upon dispensing. Generally, the following two requirements exist for this device configuration.

Requirement 1: as shown in FIG. 16A, in a case where a storage width X1 of a depositing/dispensing port 100 is equal to or greater than an exit and entrance width X2 of a reflux box 700, when banknotes are set in a position extremely biased in the storage width X1 regarding the width direction, or when the banknotes are badly skewed due to poor condition of the banknotes during the transfer, a trouble such as paper jam or poor posture may occur upon storage of the banknotes in the reflux box 700. Accordingly, it is desirable that the storage width X1 of the depositing/dispensing port 100<the exit and entrance width X2 of the reflux box 700 holds as size relationship.

Requirement 2: as shown in FIG. 16B, in a case where the storage width X1 of the depositing/dispensing port 100 is equal to or smaller than the exit and entrance width X2 of the reflux box 700, when the banknotes are set in a position extremely biased in the exit and entrance width X2 regarding the width direction, or when the banknotes are badly skewed due to poor condition of the banknotes during the transfer, a trouble such as paper jam or poor posture may occur upon storage of the banknotes in the depositing/dispensing port 100. Accordingly, it is desirable that the storage width X1 of the depositing/dispensing port 100>the exit and entrance width X2 of the reflux box 700 holds as size relationship.

The above two requirements contradict each other and there is no disclosure about the countermeasure against this problem in Japanese Unexamined Patent Application Publication No. 2012-73875. Note that the "width direction" means a vertical direction to the banknote transfer direction.

SUMMARY OF THE INVENTION

The present invention has been made in view of the above situation, and provides a cash automatic transaction device capable of preventing occurrence of trouble such as paper jam or poor posture upon storage of banknotes fed from the depositing/dispensing port in a banknote storage box or upon accumulation of the banknotes fed from the banknote storage box in the depositing/dispensing port.

To solve the above problems and to attain the object, a cash automatic transaction device according to the present invention has a depositing/dispensing port used for depositing/dispensing of banknotes, and a banknote storage box for storing deposited/dispensed banknotes. The depositing/dispensing port has depositing/dispensing space to store the deposited/dispensed banknotes, and accumulation space in which banknotes are accumulated upon dispensing. The width of the depositing/dispensing space is smaller than the exit and entrance width of the storage box. Further, the width of the accumulation space is greater than the exit and entrance width of the storage box.

According to the present invention, upon storage of banknotes fed from the depositing/dispensing port in the banknote storage box or upon accumulation of the banknotes fed from the banknote storage box in the depositing/dispensing port, it is possible to prevent occurrence of trouble such as paper jam or poor posture.

DETAILED DESCRIPTION OF THE PREFERRED EMBODIMENTS

Hereinbelow, an embodiment of a cash automatic transaction device according to the present invention will be described using the drawings.

Figure 1:
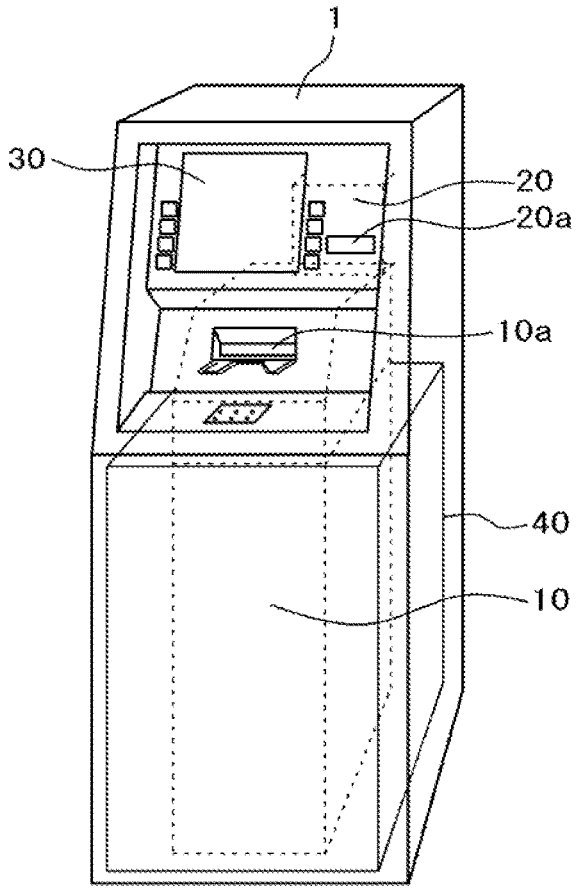
FIG. 1 is a perspective diagram showing the outer appearance of the cash automatic transaction device.

FIG. 1 is a perspective diagram showing the outer appearance of a cash automatic transaction device (ATM: Automated Teller Machine) according to the present invention. A cash automatic transaction device 1 holds banknote(s) deposited (putted in) from a user inside, and dispenses (discharges) the banknote(s) held inside to the user. The cash automatic transaction device 1 has a banknote transaction device 10, a card/receipt processing mechanism 20, a client operation part 30, and a cash box housing 40.

The banknote transaction device 10 performs banknote depositing processing, dispensing processing, discrimination processing and the like via a banknote slot 10*a* through which banknotes are putted in by users and are discharged to the users. Further, the banknote transaction device 10 is provided with a banknote storage box to store banknotes in its lower part. The banknote storage box is surrounded by the cash box housing 40. The detailed structure of the banknote transaction device 10 will be described later.

The card/receipt processing mechanism 20 is provided on the upper right side in the cash automatic transaction device 1. The card/receipt processing mechanism 20 performs insertion and discharge of a user's cash card or the like used upon transaction, discharge of a receipt on which statement of account is printed, via a card insertion port/receipt issuance port 20*a*. Further, the card/receipt processing mechanism 20 performs reading/writing of information from/into a magnetic stripe added to the card, and printing of statement of account.

The client operation part 30 is provided on the upper left side in the cash automatic transaction device 1. The client operation part 30 has a display part such as an LCD (Liquid Crystal Displace) and key-type operation part. The client operation part 30 displays a transaction selection screen and various transaction execution screens to the user of the cash automatic transaction device 1, and accepts the user's selection.

Figure 2:
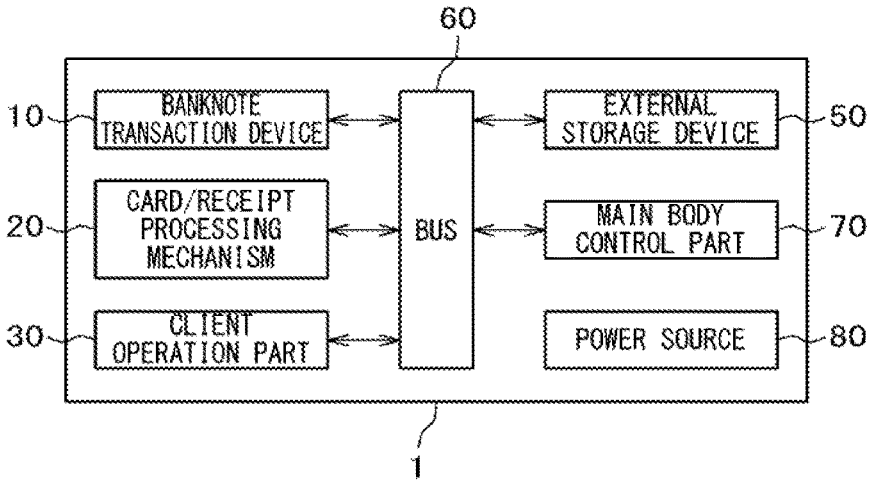
FIG. 2 is a functional block diagram of a cash automatic transaction device 1.

FIG. 2 is a functional block diagram of the cash automatic transaction device 1. The cash automatic transaction device 1 has the banknote transaction device 10, the card/receipt processing mechanism 20, the client operation part 30, and an external storage device 50. These devices and mechanisms are connected via a bus 60 to a main body control part 70, and perform necessary operations under the control of the main body control part 70. Further, the respective mechanisms and constituent elements are supplied with electric power from a power source 80.

Figure 3:
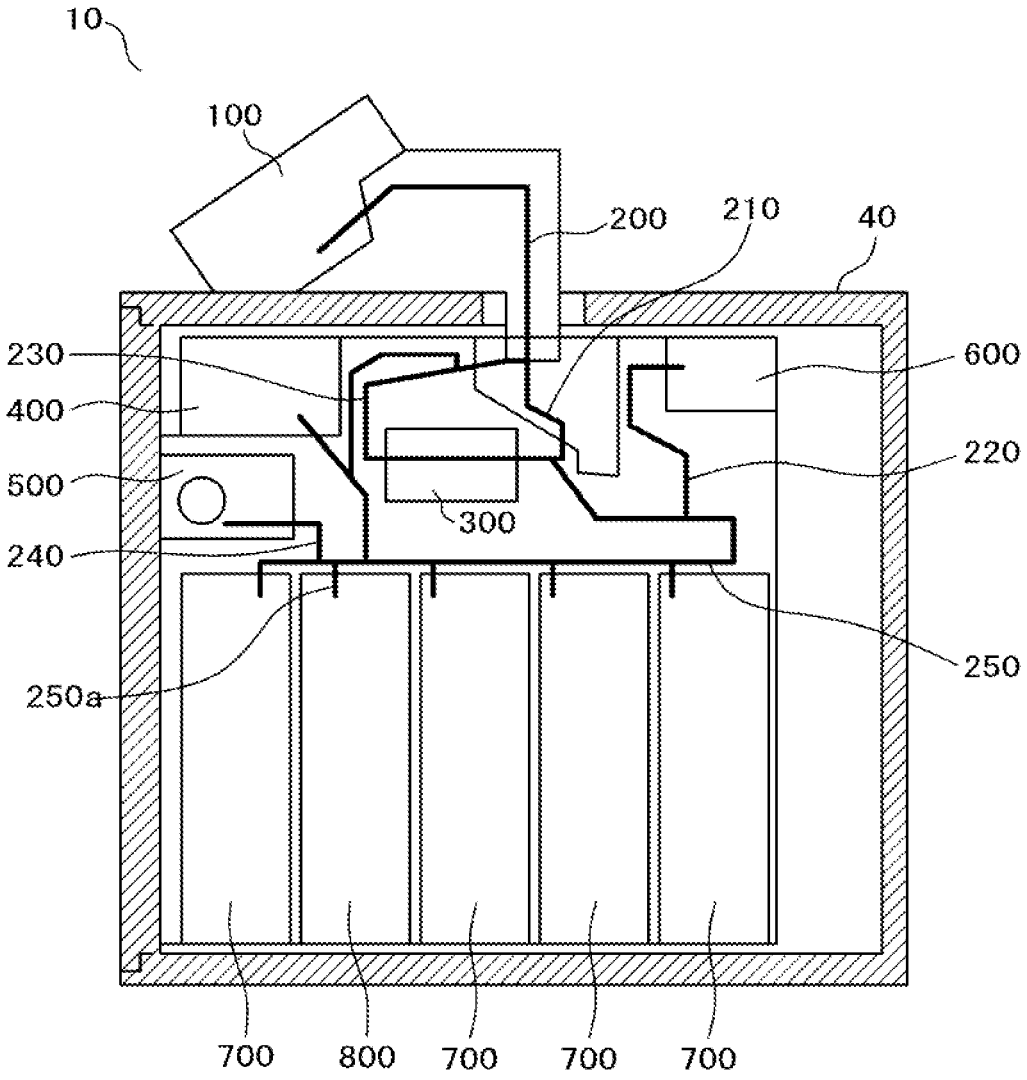
FIG. 3 is a side view showing a configuration of a banknote transaction device 10.

FIG. 3 is a side view showing the configuration of the banknote transaction device 10. The banknote transaction device 10 is provided with the depositing/dispensing port 100 in its upper left part. In the depositing/dispensing port 100, "depositing" to receive banknotes putted in from the outside and "dispensing" to store banknotes to be discharged to the outside are performed in the same location.

The banknote transaction device 10 is provided with a discrimination part 300 to acquire discrimination information of a transferred banknote at its central part. Note that the discrimination information of a banknote includes e.g. banknote denomination information, authenticity information (whether the banknote is a genuine banknote or a forged banknote, or whether or not forgery of the banknote is suspected, or whether or not the banknote is not recognized as a banknote), and banknote state information (whether or not the banknote is broken or wrinkled). Note that handled banknotes are classified into "normal banknote", "reject banknote" and "forged banknote" in accordance with acquired banknote information. Note that the "normal banknote" is a banknote appropriate to storage in the banknote transaction device 10 and dispensing. The "reject banknote" is a banknote determined that it can be handled inside the banknote transaction device 10 but not appropriate to dispensing to another user.

Further, the discrimination part 300 reads specific information to respective banknotes (e.g. printed serial numbers) different from the discrimination information, to recognize them as different banknotes even when there are plural banknotes of the same denomination or in the same authenticity state.

A first temporary storage box 400 for temporary storage of normal banknotes among the deposited banknotes by establishment of transaction is provided on the upper left side of a middle part of the banknote transaction device 10.

A second temporary storage box 500 for temporary storage of reject banknotes among the deposited banknotes by establishment of the normal banknote transaction is provided on the lower left side of the middle part of the banknote transaction device 10.

A storage box 600 for storage of forged banknotes and normal banknotes, dispensed to the depositing/dispensing port 100 but inadvertently left behind by the user after the establishment of the normal banknote transaction, is provided on the upper right side of the middle part of the banknote transaction device 10.

The storage box 600 has an upper shelf part for storage of deposited forged banknotes, a lower shelf part for storage of dispensed and inadvertently-left normal banknotes, and a partition plate between the upper shelf and the lower shelf.

A non-reflux box 800 only for storage of banknotes and a reflux box 700 for storage and discharge of banknotes are provided in the lower part of the banknote transaction device 10. The non-reflux box 800 and the reflux box 700 are referred to as a banknote storage box.

The non-reflux box 800 is a storage box for storage of reject banknotes occurred upon depositing processing and dispensing processing. Note that in the present embodiment, it may be configured such that the reflux box 700 and the non-reflux box 800 are a two-stage storage box having a two-stage storage space for storage of banknotes classified into two types. The reflux box 700 is a storage box for storage of normal banknotes appropriate to dispensing among deposited banknotes. Upon depositing processing, the paper sheets are stored by denomination, and upon dispensing processing, a designated number of paper sheets are discharged.

Note that it is possible to change the setting of the non-reflux box 800 and the reflux box 700 by setting with software or by setting of a dip switch (not shown). For example, the non-reflux box 800 may be used as a reflux box, while the reflux box 700 may be used as a non-reflux box.

Further, the non-reflux box 800 and the reflux box 700 have the same external form. In the respective boxes, a banknote depositing/dispensing port (or inlet) is provided in the same position. Accordingly, the box positions may be exchanged without setting using software or a dip switch (not shown).

Further, it is possible to designate the denomination of banknotes to be stored in the reflux box 700 by setting with software or a dip switch. It may be configured such that banknotes of the same denomination are stored in plural reflux boxes. The depositing/dispensing port 100, the discrimination part 300, the first temporary storage box 400, the second temporary storage box 500, the storage box 600 for storage of forged and inadvertently-left banknotes, the non-reflux box 800, and the reflux box 700 are connected via transfer paths 200, 210, 220, 230, 240, and 250.

The transfer paths 200, 210, 220, 230, 240, and 250 are driven with a driving source (not shown). Note that it may be configured such that individual driving sources are provided for the respective transfer paths, or plural transfer paths are driven with one driving source. Further, a gate (not shown) is provided at a branch point of the respective transfer paths.

The transfer path 200 connects the depositing/dispensing port 100 with the inside of the cash box housing 40. The transfer path 210 is used for transfer of the banknotes between the discrimination part 300 and the transfer path 200. The transfer path 220 is used for transfer of the forged and inadvertently-left banknotes to the storage box 600. The transfer path 230 is used for transfer of the banknotes between the discrimination part 300 and the first temporary storage box 400. The transfer path 240, connected to the second temporary storage box 500, is used for transfer of the reject banknotes to the second temporary storage box 500 (or transfer of the reject banknotes from the second temporary storage box 500). The transfer directions of these transfer paths are changed with the gates (not shown). The transfer paths 250 and 250*a* are used for transfer of the banknotes among the gates (not shown), and the non-reflux box 800 and the reflux box 700. The storage of the banknotes to the non-reflux box 800 and the reflux box 700 and the feeding of the banknotes from the reflux box 700 are changed with the gates (not shown).

Further, a transfer path sensor (not shown) for detection of the existence of banknote is provided on the respective transfer paths. The transfer path sensor has e.g. an infrared light-emitting part and an infrared-light receiving part provided in a position opposing the infrared light-emitting part via the transfer path. The transfer path sensor detects the dark/bright state of the infrared-light receiving part to detect the existence of the banknote.

Figure 4:
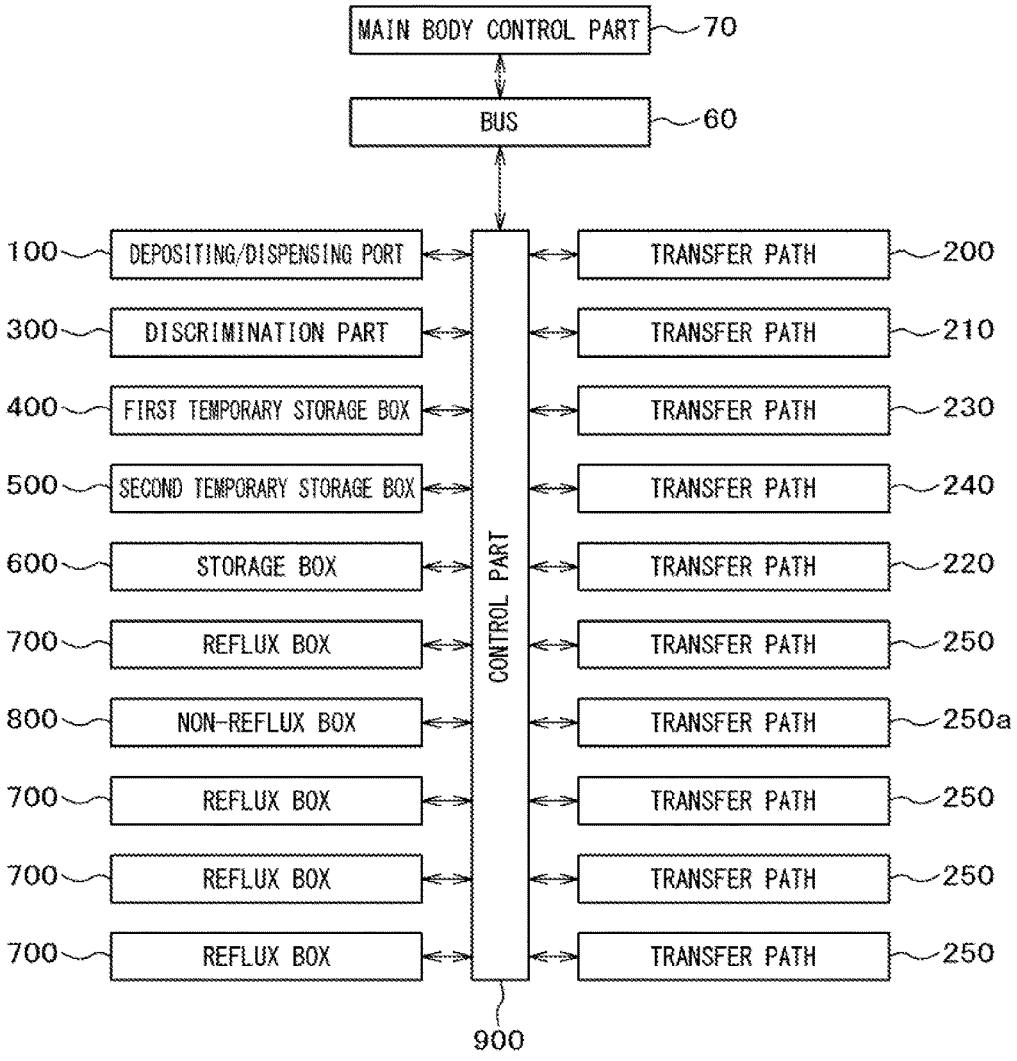
FIG. 4 is a block diagram showing a configuration of the banknote transaction device 10.

FIG. 4 is a block diagram showing the configuration of the banknote transaction device 10. The banknote transaction device 10 has the depositing/dispensing port 100, the discrimination part 300, the first temporary storage box 400, the second temporary storage box 500, the forged/inadvertently-left banknote storage box 600, the non-reflux box 800, the reflux box 700, the transfer paths 200 to 250 and 250*a*, the gates (not shown), and a storage part (not shown). These respective mechanisms and constituent elements are connected to a control part 900, and perform necessary operations under the control of the control part 900.

That is, the control part 900 receives a command from the main body control part 70 via the bus 60 of the cash automatic transaction device 1. The control part 900 controls the respective mechanisms and constituent elements based on the command.

The storage part (not shown) is e.g. a RAM (Random Access Memory) which holds discrimination information (denomination information, authenticity information, and state information) of paper sheets discriminated with the discrimination part 300 and specific information to the respective paper sheets (e.g. serial numbers printed on the paper sheets).

Next, a banknote depositing operation will be described. The banknote depositing/dispensing operation includes an operation to deposit banknotes putted in by the user into a banknote depositing/dispensing machine (depositing operation) and an operation to dispense banknotes stored in the banknote depositing/dispensing machine to the user (dispensing operation). Further, the depositing operation includes an operation to count the number of banknotes putted in by the user (deposited banknotes counting operation), an operation to return reject banknotes among the counted banknotes, after the discrimination with the discrimination part 300, to the user (reject returning operation), and an operation to store the counted banknotes into the non-reflux box 800 and the reflux box 700 (depositing storage operation).

Figure 5:
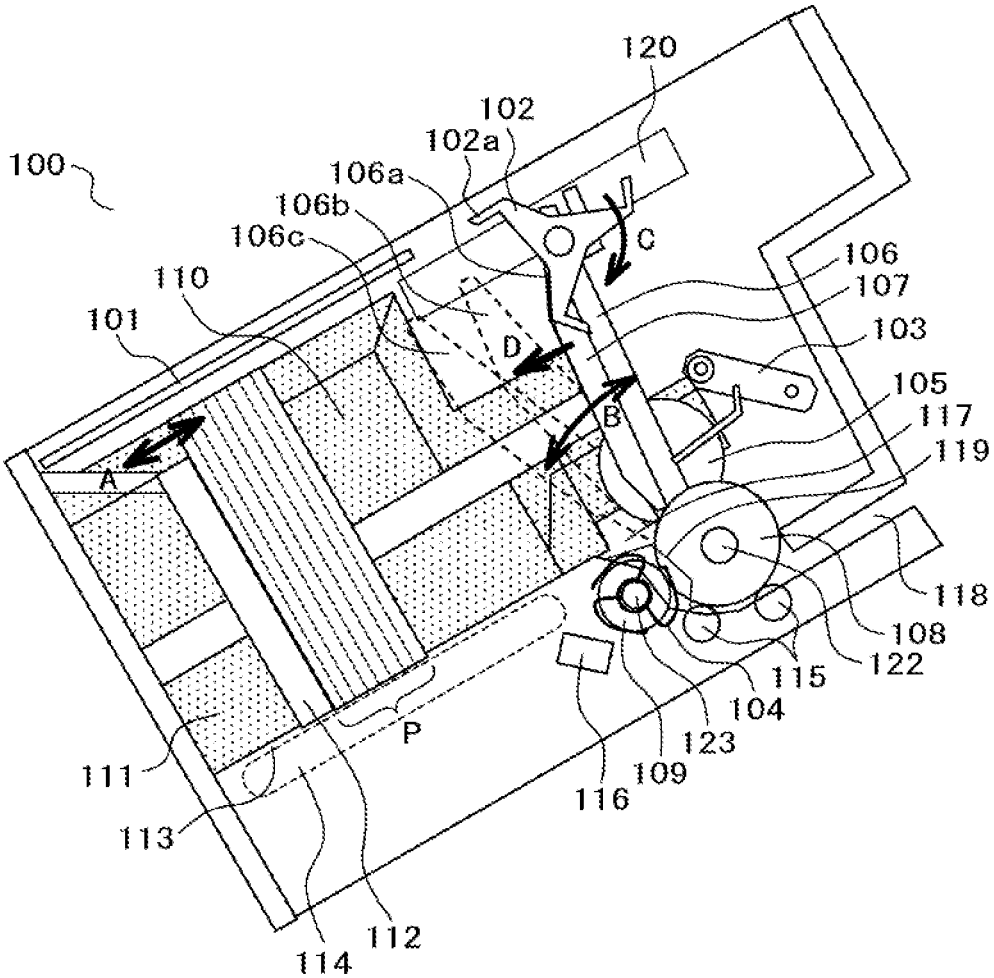
FIG. 5 is a side view of the depositing/dispensing port 100.
Figure 6:
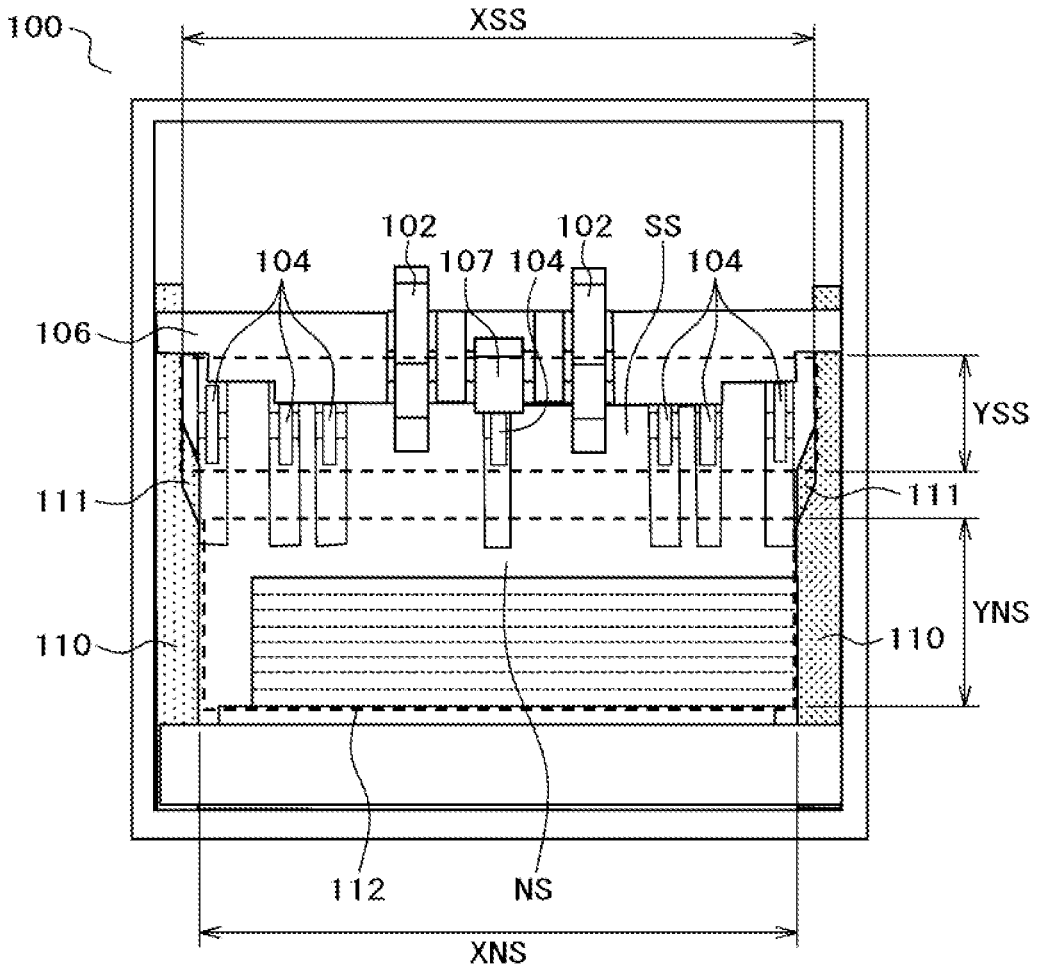
FIG. 6 is a top view of the depositing/dispensing port 100.

Hereinbelow, the configuration of the depositing/dispensing port 100 according to the present embodiment will be described in detail. FIG. 5 is a side view of the depositing/dispensing port 100. FIG. 6 is a top view of the depositing/dispensing port 100.

The depositing/dispensing port 100 is a mechanism to transfer paper sheets putted in by the user into the device, to discharge paper sheets transferred from the inside of the device, in an accumulated and arrayed state, to a person in charge.

The depositing/dispensing port 100 has a separation/accumulation mechanism to separate the putted-in paper sheets, and accumulate paper sheets fed from the reflux box 700. The separation/accumulation mechanism has a pressing mechanism 112 to hold and push the paper sheets upward, a pickup roller 105, a feed roller 108, and a gate roller 109. The paper sheets putted in the depositing/dispensing port 100 are pressed with the pressing mechanism 112 and the pickup roller 105, and sent to a position between the feed roller 108 and the gate roller 109, further, separated one by one with the pickup roller 105, the feed roller 108 and the gate roller 109, then fed to the transfer path 200 outside the depositing/dispensing port 100 and inside the device.

The depositing/dispensing port 100 has a floorboard 113, a bottom belt 114 put so as to support a lower surface of the paper sheet in a position above the floorboard 113, the pressing mechanism 112 which moves in a longitudinal direction of the device, a top board 101, the upper side plate 110, the lower side plate 111, a separation/accumulation guide (guide member) 106, a backup roller 115, a brush roller 104, an inlet/discharge port 117 having a transmission type sensor (residual paper sheet detection sensor) 116, a paper sheet transfer path 118, a progression regulation part 102, an out-of-plane deformation applying mechanism 119, a pushout lever 107, a top board guide 120, a spring (elastic member) 121, and a lock link mechanism 103.

Further, the pressing mechanism 112 is driven with a push plate driving motor (not shown) in an arrow A direction.

The separation/accumulation mechanism further has the backup roller 115, the brush roller 104, the separation/accumulation guide 106, an inlet/discharge port 117 having the transmission type sensor (residual paper sheets detection sensor) 116, the paper sheet transfer path 118, and the progression regulation part 102, in addition to the feed roller 108, the pickup roller 105, the gate roller 109, and the pressing mechanism 112 described above.

Further, the out-of-plane deformation applying mechanism 119 is provided in the vicinity of the feed roller 108 and the gate roller 109. Further, a pushout mechanism (the pushout lever 107, the top board guide 120, and a spring 121 as shown in FIG. 9) is provided above the separation/accumulation guide 106.

The separation/accumulation guide 106 guides the paper sheets on the paper sheet transfer path 118 to the inlet/discharge port 117, and guides the paper sheets from the inlet/discharge port 117 to the paper sheet transfer path 118. In the separation/accumulation guide 106, a surface on the inlet/discharge port 117 side is used as a surface on the accumulation space side as a paper sheet guide surface.

The backup roller 115 is rotated in accordance with rotation of the feed roller 108, to hold and transfer the paper sheet between the backup roller 115 and the feed roller 108 opposite to the backup roller 115 via the paper sheet transfer path 118.

The brush roller 104 is a roller in a vane wheel shape, configured with flexible J-shaped sheet type push-in members radially provided in at least three directions, provided coaxially with a central axis 123 of the gate roller 109. Note that the push-in members may be radially in four or more directions.

The paper sheet transfer path 118, communicated with the transfer path 200, to allow passage of paper sheets to be separated/accumulated.

The progression regulation part 102 provided above the separation/accumulation guide 106 has arm members 102*a* (three in FIG. 5) to regulate the progression of the paper sheets, which enter the depositing/dispensing port 100 through the paper sheet transfer path 118 and are accumulated, in a position above the paper sheets. In this embodiment, progression regulation part 102 is provided coaxially in two positions. Further, the progression regulation part 102 is rotate-driven about the central axis in an arrow C direction with a progression regulation part motor.

The pushout lever 107 is pivoted about a central axis (not shown) in an arrow D direction. Further, the lock link mechanism 103 is vertically operated about a central axis with an actuator (not shown). The detailed operations of these mechanisms will be described later.

The feed roller 108 is driven with a feed roller driving motor. The feed roller 108 holds a paper sheet with the backup roller 115 oppositely positioned to the feed roller 108 via the paper sheet transfer path 118, transfers a paper sheet to be accumulated to the accumulation space SS, and sends a paper sheet to be separated via the paper sheet transfer path 118 to the transfer path 200.

The gate roller 109 is rotated about the central axis 123 in a paper sheet accumulation direction but not rotated in a feeding direction by using e.g. a one-way clutch.

With these constituent elements, the separation/accumulation mechanism separates the paper sheets, putted in the depositing/dispensing port 100, and infallibly discharges them, one by one, upon depositing. Further, the separation/accumulation mechanism infallibly accumulates the paper sheets passed through the paper sheet transfer path 118 in the depositing/dispensing port 100.

The separation/accumulation guide 106 is pivoted about a lower pivot axis 122 in an arrow B direction. With this configuration, the separation/accumulation guide 106 is rotated to a paper sheet separation position 106*a*, to a paper sheet accumulation position 106*b*, or to a paper sheet put-in/discharge position 106*c*, in accordance with operation.

In detail, upon paper sheet accumulation, the separation/accumulation guide 106 is pivoted, with the paper sheet guide surface along a line extended in the paper sheet feeding direction in the inlet/discharge port 117 of the paper sheet transfer path 118, to the paper sheet accumulation position 106*b* to function as a space forming position.

Further, upon paper sheet separation, the separation/accumulation guide 106 is retracted from the paper sheet guide surface until the pickup roller 105 is exposed, and pivoted to the paper sheet separation position 106*a* to function as a guide position to guide paper sheets to the paper sheet transfer path 118. Note that the paper sheet separation position 106*a* is positioned in the rear of the paper sheet accumulation position 106*b*.

Further, upon paper sheet put-in/discharging, the separation/accumulation guide 106 is pivoted to the paper sheet put-in/discharge position 106*c* fallen from the paper sheet accumulation position 106*b* to the accumulation space SS side so as to form space to allow the paper sheet put-in/discharging.

Note that the paper sheet put-in/discharge position 106*c* is positioned in front of the paper sheet separation position 106*b*. That is, the separation/accumulation guide 106 is configured to be displaced to the paper sheet accumulation position (first position) 106*b*, the paper sheet separation position (second position) 106*a*, and the paper sheet put-in/discharge position (third position) 106*c*.

Regarding the inside of the depositing/dispensing port 100, the space in which the user puts in banknotes upon depositing or the space where banknotes are picked up upon dispensing is depositing/dispensing space NS, and the space where currently-being accumulated banknotes temporarily exist upon dispensing is the accumulation space SS. The depositing/dispensing space NS is positioned on the user side from the accumulation space SS. The accumulation space SS is formed on the device inner side from the depositing/dispensing space NS. The depositing/dispensing space NS and the accumulation space SS have the pressing mechanism 112, the upper side plate 110, the lower side plate 111, the separation/accumulation guide 106, and the floorboard 113. The width of the depositing/dispensing space NS is XNS, and the depth, YNS. Further, the width of the accumulation space SS is XSS, and the depth, YSS. Note that the width means a length in a direction vertical to the transfer direction of putted-in banknotes, and the depth is a length in the operation direction of the pressing mechanism 112 to press the banknotes with a member such as a push plate.

Figure 7:
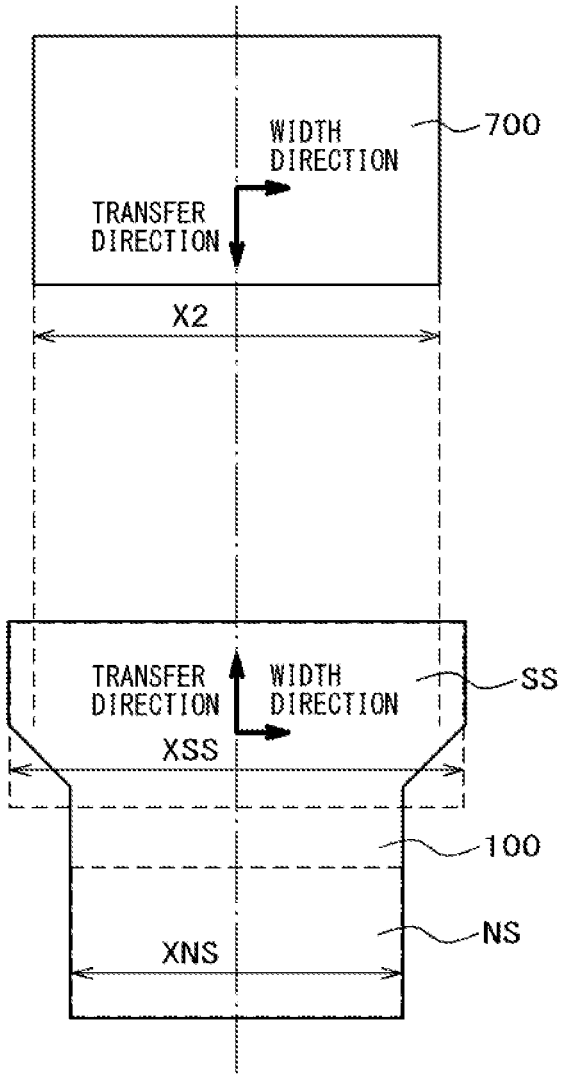
FIG. 7 illustrates relationship between the width of accumulation space/the width of depositing/dispensing space and the exit and entrance width of a reflux box.

FIG. 7 shows the relationship among the width XSS of the accumulation space SS, the width XNS of the depositing/dispensing space NS, and an exit and entrance width X2 of the reflux box 700. As shown in the figure, the width XSS of the accumulation space SS is greater than the exit and entrance width X2 of the reflux box 700 (XSS>X2). Further, the width XNS of the depositing/dispensing space NS is set to be smaller than the exit and entrance width X2 of the reflux box 700 such that even when a banknote is skewed while it is transferred, the edge of the banknote does not exceed the exit and entrance width X2 of the reflux box 700 (XNS<X2). In this manner, in the depositing/dispensing port 100 according to the present embodiment, the depositing/dispensing space NS and the accumulation space SS having different widths exist in the same mechanism.

Figure 8A:
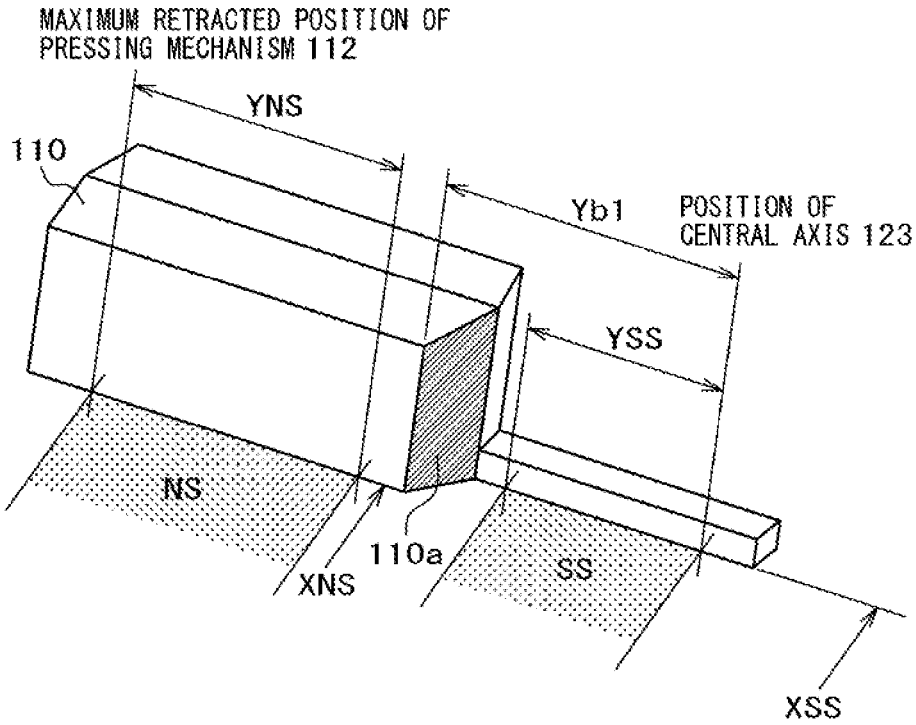
FIG. 8A illustrates a shape of an upper side plate 110.
Figure 8B:
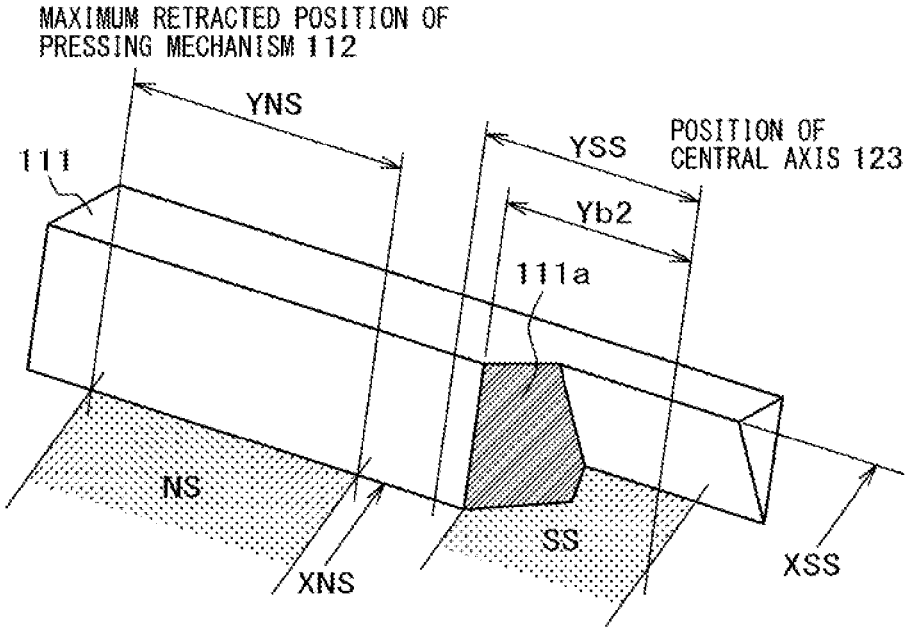
FIG. 8B illustrates a shape of a lower side plate 111.

Next, the shapes of the upper side plate 110 and the lower side plate 111 will be described in detail. FIG. 8A shows the shape of the upper side plate 110. FIG. 8B shows the shape of the lower side plate 111.

In the upper side plate 110, a portion forming the depositing/dispensing space NS (in the figure, the range of the depth YNS) and a portion forming the accumulation space SS (in the figure, the range of the depth YSS) have a flat surface shape, and a slope portion 110*a* exists between these portions. Further, in the lower side plate 111, a portion forming the depositing/dispensing space NS (in the figure, the range if the depth YNS) has a flat surface, and a part of a portion forming the accumulation space SS has a slope portion 111*a*. The width XNS of the depositing/dispensing space NS and the width XSS of the accumulation space SS are different with these slope portions 110*a* and 111*a*. Further, the width XSS of the accumulation space SS is greater than the width XNS of the depositing/dispensing space NS.

Next, the pushout mechanism provided above the separation/accumulation guide 106 will be described using the schematic configuration diagram of the separation/accumulation guide 106 schematically shown in FIGS. 9A and 9B.

Figure 9A:
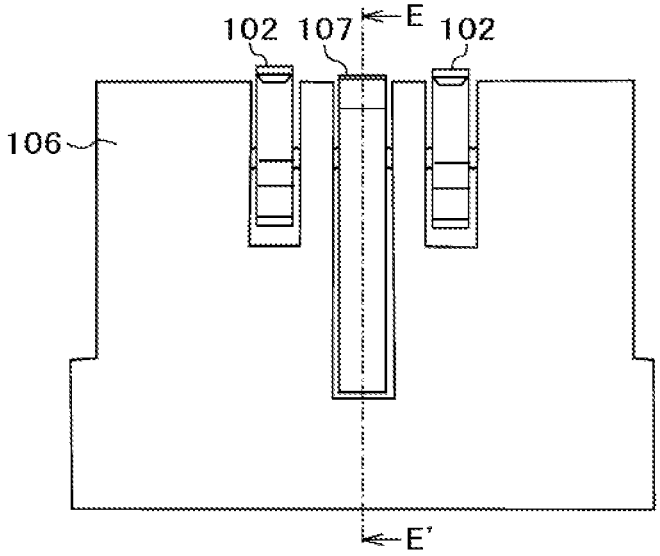
FIG. 9A is a front view of a separation/accumulation guide 106.

As shown in the front view of the separation/accumulation guide 106 in FIG. 9A, the pushout lever 107 is provided above the separation/accumulation guide 106 and at the center of the separation/accumulation guide 106.

Figure 9B:
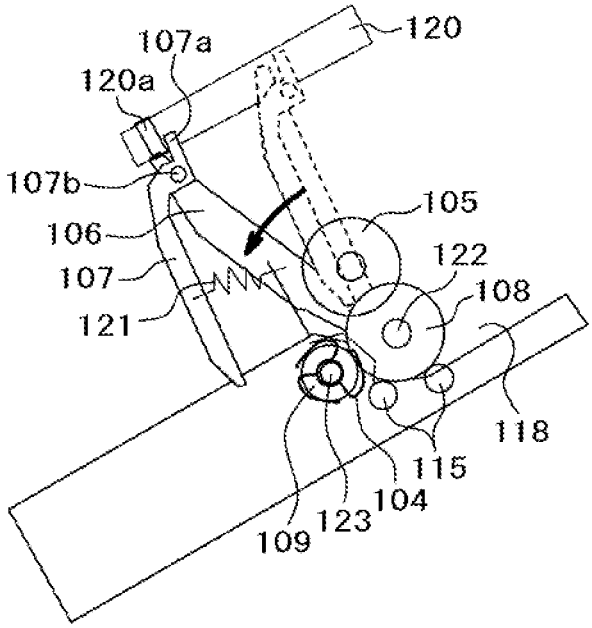
FIG. 9B is a cross-sectional diagram of the separation/accumulation guide 106.

Further, as shown in FIG. 9B (E-E' cross-sectional diagram), the pushout mechanism has the lever 107, the spring 121, and the top board guide 120.

The pushout lever 107 provided at the center of the separation/accumulation guide 106 has a shape extended in the direction of the pivot axis 122 of the separation/accumulation guide 106, so as to be retracted to a position where it is not exposed from the separation/accumulation guide 106, not in touch with banknote, and overlapped with the separation/accumulation guide 106. The upper end of the pushout lever 107 has a hook shape (hook) 107*a*.

In the pushout mechanism, by pressing with the spring 121 attached to the pushout lever 107, the pushout lever 107 is protruded from the separation/accumulation guide 106 about a central axis 107*b*, and is hidden in the position not exposed from the separation/accumulation guide 106.

The top board 101 is provided with the top board guide 120. Further, the top board guide 120 has a hole with which the pushout lever 107 is always overlapped.

Further, a hook-shaped projection 120*a* is formed in the top board guide 120. With this structure, when the separation/accumulation guide 106 is pivoted to the paper sheet put-in/discharge position 106*c*, the hook 107*a* of the pushout lever 107 and the hook 120*a* of the top board guide 120 are engaged with each other, and the pushout lever 107 is protruded from the separation/accumulation guide 106.

Figure 10A:
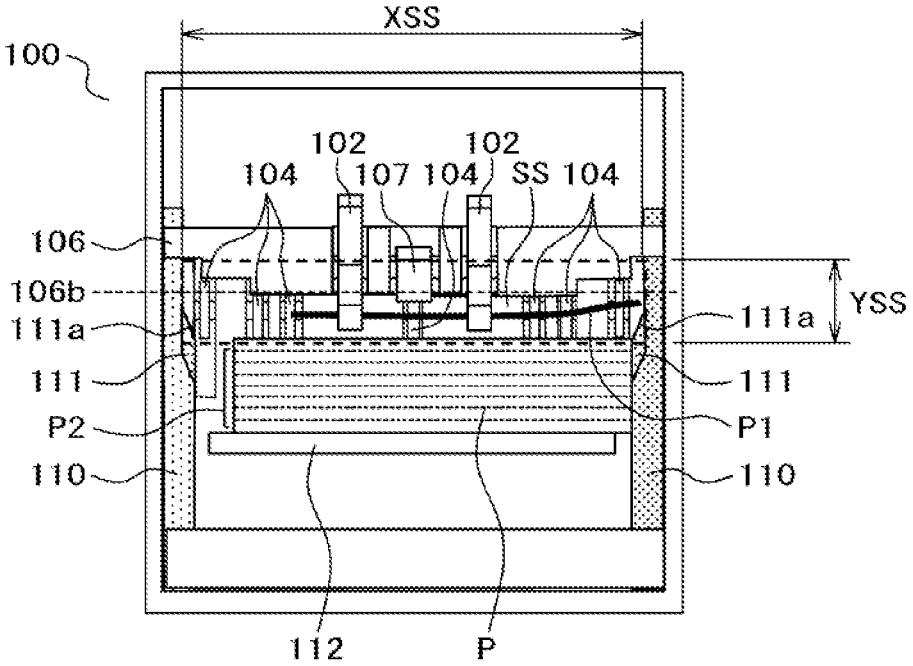
FIG. 10A illustrates the state of the depositing/dispensing port 100 upon accumulation.

Next, the states of the depositing/dispensing port 100 upon accumulation and upon depositing/dispensing will be described. FIG. 10A shows the state of the depositing/dispensing port 100 upon accumulation. A banknote P1 being accumulated is accumulated in the accumulation space SS. The accumulation space SS is formed with the separation/accumulation guide 106 existing in the paper sheet accumulation position 106*b*, the top surface of an accumulated banknote P2 after the completion of accumulation operation, the surface on the wide width side where the width of the upper side plate 110 is XSS, and the surface on the wide width side where the slope portion 111*a* or the width of the lower side plate 111 is XSS.

As described above, the width XSS of the accumulation space SS is set to be greater than the exit and entrance width X2 of the reflux box 700. Accordingly, in the depositing/dispensing port 100 according to the present embodiment, even when a banknote stored in the reflux box 700 in a biased state in the width direction is fed, it can be accumulated without occurrence of paper jam or poor posture.

Figure 10B:
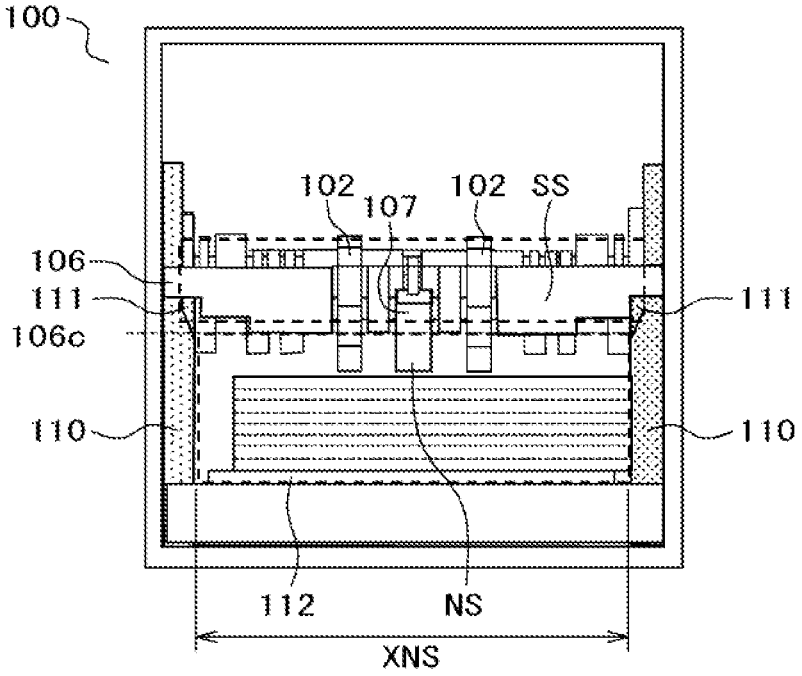
FIG. 10B illustrates the state of the depositing/dispensing port 100 upon depositing/dispensing.

FIG. 10B shows the state of the depositing/dispensing port 100 upon depositing/dispensing. Note that the banknote which the user puts in upon depositing or the banknote which the user picks up upon dispensing exists in the depositing/dispensing space NS. The depositing/dispensing space NS is formed with the separation/accumulation guide 106 existing in the paper sheet put-in/discharge position 106*c*, the pressing mechanism 112, the surface on the narrow width side where the width of the upper side plate 110 is XNS, and the surface on the narrow width side where the width of the lower side plate 111 is XNS. With this configuration, as the separation/accumulation guide 106 completely covers the accumulation space SS, upon the user's depositing, the banknote does not enter the inside of the accumulation space SS, but infallibly is putted in the depositing/dispensing space NS having the width XNS.

As described above, the width XNS of the depositing/dispensing space NS is set to be smaller than the exit and entrance width X2 of the reflux box 700, such that even when the banknote is skewed while it is transferred, the edge of the banknote does not exceed the exit and entrance width X2 of the reflux box 700. Accordingly, in the depositing/dispensing port 100 according to the present embodiment, even when the user sets the banknote in a position biased in the width direction of the depositing/dispensing port 100, it can be stored in the reflux box 700 without occurrence of paper jam or poor posture.

Figure 11:
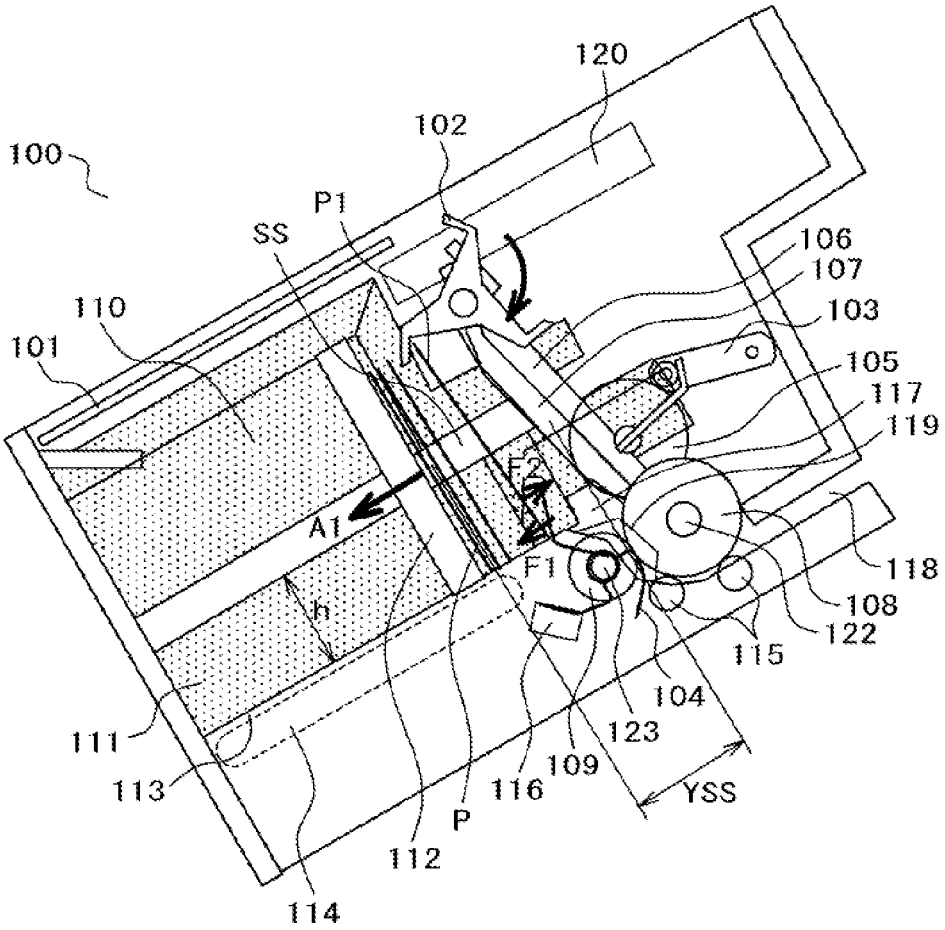
FIG. 11 is an explanatory diagram of a separation/accumulation mechanism in accumulation state.

Next, accumulation processing to accumulate paper sheets in the depositing/dispensing port 100 of the cash automatic transaction device 1 will be described. FIG. 11 is an explanatory diagram of the separation/accumulation mechanism in the accumulation state according to the present embodiment.

In a state where the separation/accumulation guide 106 of the separation/accumulation mechanism is regulated in the paper sheet accumulation position 106*b* with the lock link mechanism 103, the feed roller 108 and the gate roller 109 provided on the both side of the paper sheet transfer path 118 are rotated, and the paper sheet P is transferred to the accumulation space SS. At this time, the paper sheet P is transferred along the paper sheet guide surface of the separation/accumulation guide 106.

With respect to the paper sheet P putted in from the outside through the paper sheet transfer path 118, a paper sheet released from the holding force between the feed roller 108 and the gate roller 109 is scraped out from a holding point between the feed roller 108 and the gate roller 109 with the brush roller 104 as a rotating vane wheel, to avoid collision against the following paper sheet.

In the paper sheet P, accumulated in the accumulation space SS and released from the holding between the feed roller 108 and the gate roller 109, the end in the paper feed direction collides against a concave portion formed with the arm members 102*a* of the progression regulation part 102 then is stopped. The above operations are performed continuously, thus the paper sheet P is accumulated. The accumulated paper sheet P is moved in a direction away from the separation/accumulation guide 106 (i.e. in the figure, in an arrow A1 direction) with the pressing mechanism 112 and the bottom belt 114. Note that upon accumulation operation, the pushout lever 107 is retracted in a position not exposed from the separation/accumulation guide 106 so as not to disturb the accumulation operation for the paper sheet P.

Figure 12:
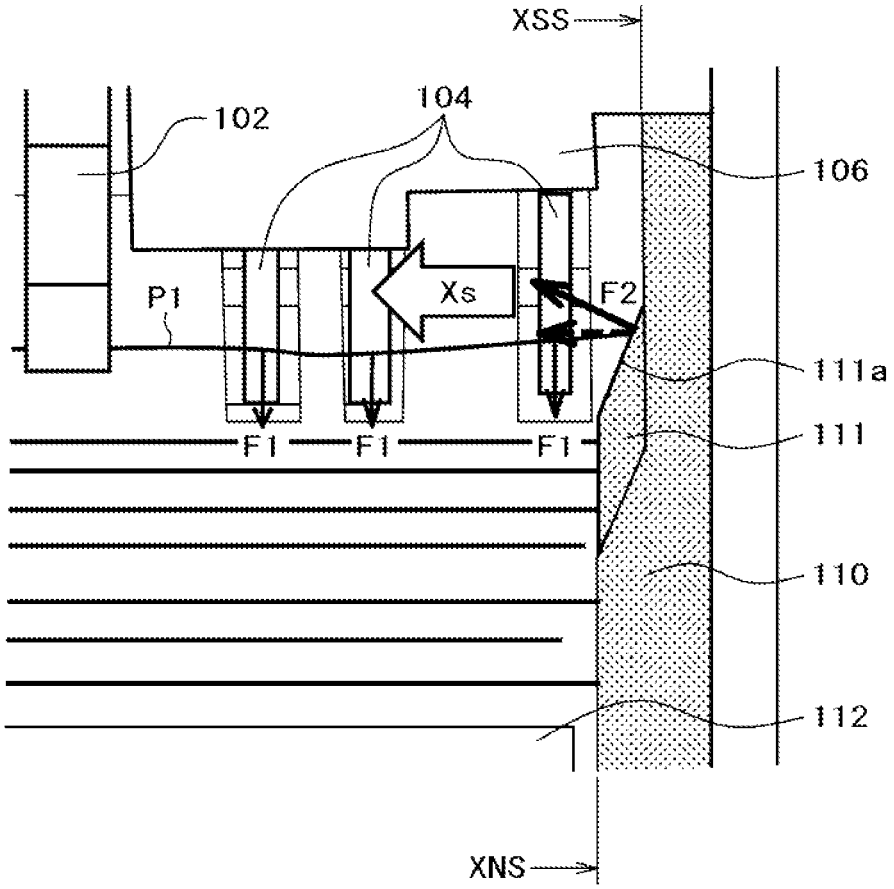
FIG. 12 is an explanatory diagram of the separation/accumulation mechanism in the accumulation state.

FIG. 12 shows the relationship of external force acting on the currently being accumulated paper sheet P1, related to the above accumulation processing operation. An external force F1 from the brush roller 104 acts on the currently being accumulated banknote P1. As shown in the figure, when the currently being accumulated banknote P1 is accumulated in an extremely biased position within the width XSS of the accumulation space SS, the end of the currently being accumulated banknote P1 is in touch with the slope portion 111*a* of the lower side plate 111.

At this time, since a contact force F2 from the slope portion 111*a* acts on the currently being accumulated banknote P1, the currently being accumulated banknote P1 is moved in the direction of an arrow Xs in the figure. Then the end of the banknote P1 is finally aligned to the position in the width XNS of the depositing/dispensing space NS, and is accumulated. At this time, when a distance between the line of action of the external force F1 from the brush roller 104 and the line of action of the contact force F2 from the slope portion 111*a* is long, the banknote is rotated due to the action of clockwise moment in FIG. 11 on the banknote P1, and the movement to the above width direction may be disturbed. However, in the configuration according to the present embodiment, the slope portion 110*a* of the upper side plate 110 exists on the rear side (the lower side in FIG. 12) from the slope portion 111*a* of the lower side plate 111. Upon contact between the slope portion 111*a* and the banknote, the banknote does not come into contact with the upper side plate. Accordingly, the maximum value of the above rotation moment is limited by regulating a height h of the lower side plate.

Figure 13:
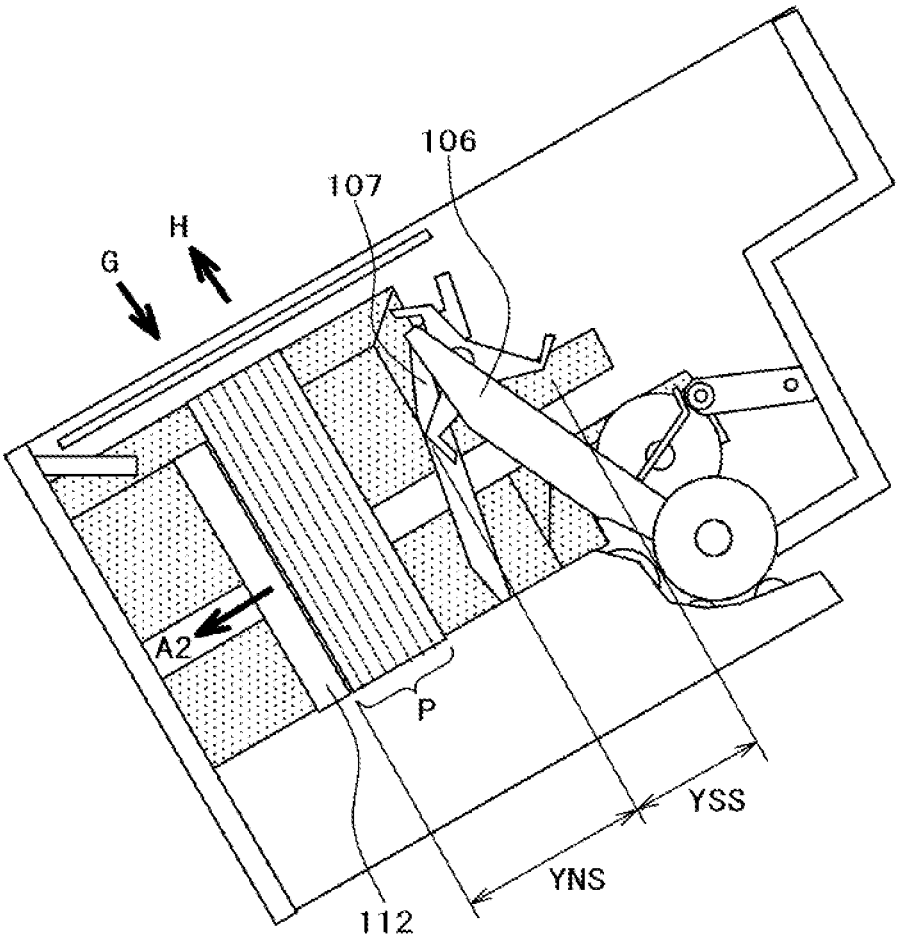
FIG. 13 is a side view of the separation/accumulation mechanism upon put-in and delivery of paper sheets.

Next, the operation to accumulate the paper sheet putted in the depositing/dispensing port 100 and the operation to discharge the accumulated paper sheet to the user will be described. FIG. 13 is a side view of the separation/accumulation mechanism upon paper sheet put-in and upon paper sheet delivery according to the present embodiment.

As shown in FIG. 13, when the paper sheet P is putted in the depositing/dispensing space NS in an arrow G direction, the pressing mechanism 112 is set in the most retracted position, the separation/accumulation guide 106 is set in the paper sheet put-in/discharge position 106*c*, and the pushout lever 107 of the separation/accumulation guide 106 is protruded. At this time, the space formed with the pressing mechanism 112 and the pushout lever 107 allows put-in of the paper sheet P inside and accumulation of the paper sheets P.

Further, when it is possible to take out the paper sheet P in an arrow H direction (i.e., upon paper sheet delivery), the pressing mechanism 112 is moved in a device frontward direction (an arrow A2 direction in the figure). Then the pushout lever 107 is moved to a front position in the device, which regulates the movement of the paper sheet P. It is possible to deliver the paper sheet P to the user while preventing the paper sheet P from falling. At this time, the arm member 102*a* of the progression regulation part 102 is rotated to a position not disturb the put-in and the delivery of the paper sheet.

Figure 14:
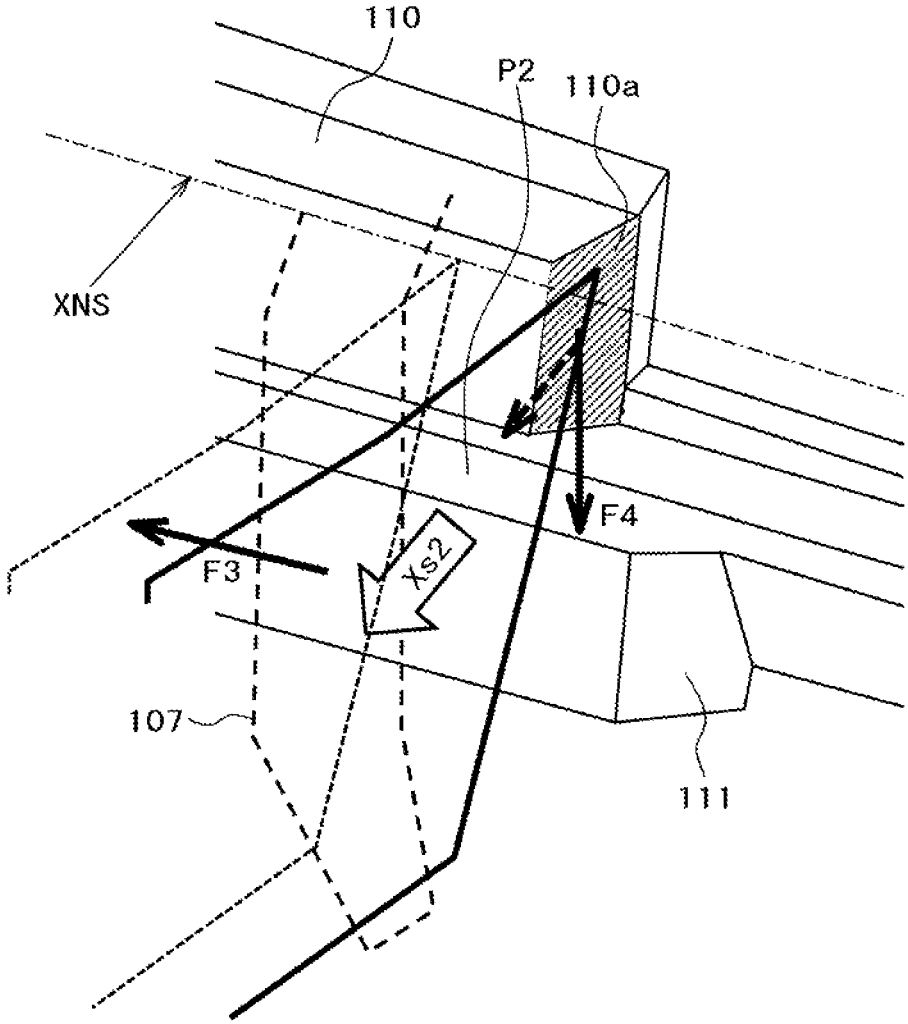
FIG. 14 illustrates relationship of external force acting on a discharged banknote P2.

FIG. 14 shows the relationship of external force acting on the discharged banknote P2, concerning the operation to discharge the above-described accumulated paper sheet to the user. An external force F3 from the pushout lever 107 acts on the discharged banknote P2. As shown in the figure, when the discharged banknote P2 is accumulated in a skewed state, a corner of the discharged banknote P2 becomes into contact with the slope portion 110*a* of the upper side plate 110. At this time, a contact force F4 from the slope portion 110*a* acts on the discharged banknote P2. Accordingly, the discharged banknote P2 is moved in an arrow Xs2 direction in the figure. Then the corner is finally aligned to the position of the width XNS of the depositing/dispensing space NS, and the banknote is discharged.

Figure 15:
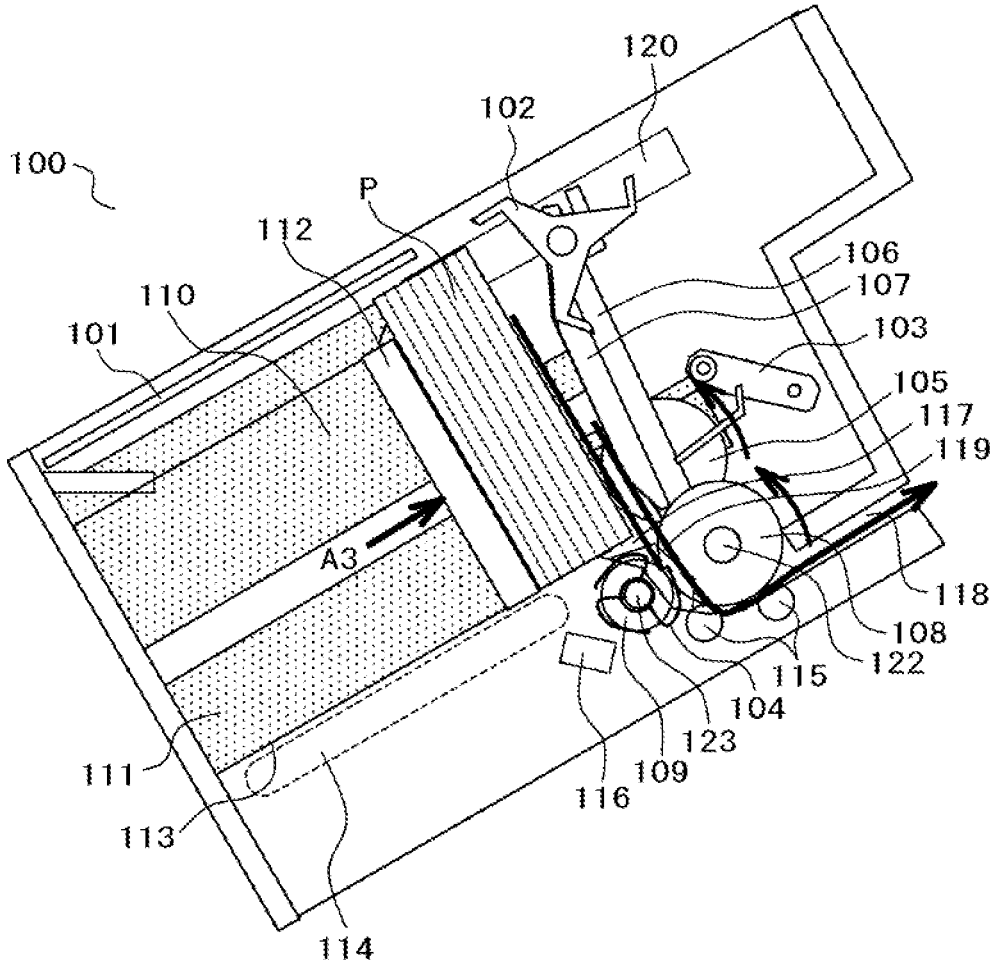
FIG. 15 is a side view of the separation/accumulation mechanism in separation state.
Figure 16A:
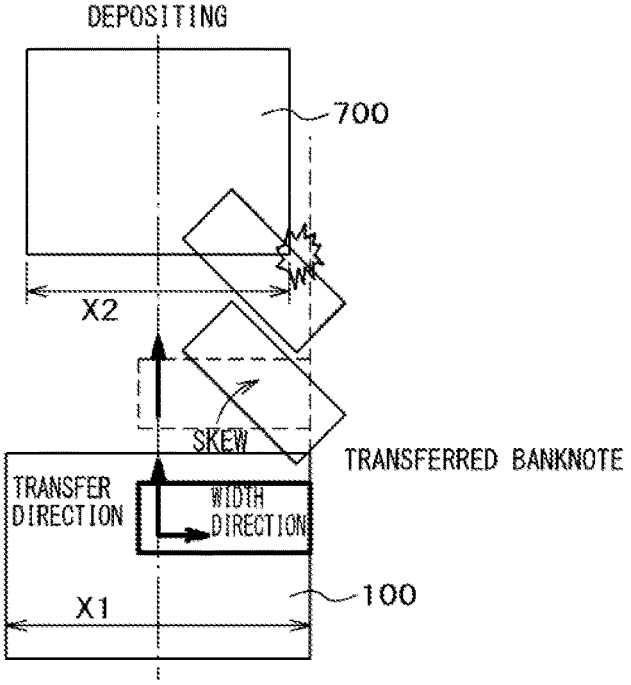
FIG. 16A is an explanatory diagram of the problem.
Figure 16B:
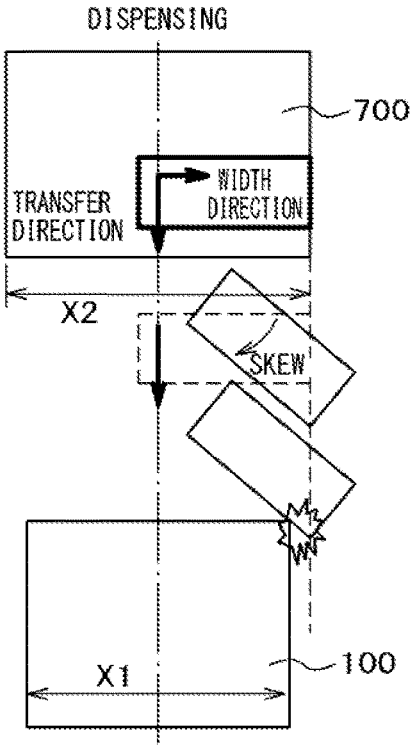
FIG. 16B is an explanatory diagram of the other problem.

Next, the operation to separate the paper sheet putted in the depositing/dispensing port 100 will be described. FIG. 15 is a side view of the separation/accumulation mechanism in the separation state. Upon separation of the paper sheet, the pressing mechanism 112 is driven in an arrow A3 direction as a preparation operation, to press the paper sheet against the separation/accumulation guide 106. At this time, the separation/accumulation guide 106 is pushed with the pressing mechanism 112 or the accumulated paper sheet P, then the pushout lever 107 protruded from the separation/accumulation guide 106 is retracted to a position where it is not exposed. Further, since the separation/accumulation guide 106 is moved to the paper sheet separation position 106*a*, the pickup roller 105 is exposed from the paper sheet guide surface, and the pickup roller 105 is in contact with the paper sheet P.

Therefore, the pickup roller 105 is rotated, to transfer the paper sheets P, while separate the paper sheets one by one, to the paper sheet transfer path 118. At this time, the brush roller 104, with sheet type push-in members rolled not to disturb the separation of the paper sheets P, is rotated. Further, the pressing mechanism 112 and the bottom belt 114 are interlocked with each other so as to apply predetermined pressure to the pickup roller 105. In this manner, upon separation, the separation/accumulation mechanism separates the paper sheets P, putted in the depositing/dispensing space NS, one by one, and infallibly discharges them.

As described above, in the cash automatic transaction device according to the present embodiment, the depositing/dispensing space NS for storage of deposited banknotes and dispensed banknotes, and the accumulation space SS for temporary storage of the banknotes upon dispensing of the banknotes to the user, exist in the depositing/dispensing port 100. The width XNS of the depositing/dispensing space NS is smaller than the width XSS of the accumulation space SS.

Accordingly, in the depositing/dispensing port 100 according to the present embodiment, even when a banknote biased in the width direction and accumulated in the reflux box 700 is fed, and the banknote is accumulated, the occurrence of trouble such as paper jam or poor posture is prevented. Further, even when the user sets a banknote in the depositing/dispensing port 100 in a position biased in the width direction, it is possible to store the banknote in the reflux box 700 without occurrence of paper jam or poor posture.

Further, upon depositing/dispensing, as the separation/accumulation guide 106 exists in the paper sheet put-in/discharge position 106*c*, the separation/accumulation guide 106 completely covers the accumulation space SS. Upon depositing by the user, the banknotes are infallibly putted within the range of the width XNS.

Further, the lower side plate 111 as a constituent element of the accumulation space SS has a slope portion 111*a*. The position of the currently being accumulated banknote is regulated in the width direction. The banknote, with the end finally aligned to the position in the width XNS of the depositing/dispensing space NS, is accumulated.

That is, in the depositing/dispensing port, the length in the width direction of the space where the banknotes are deposited is smaller than the entrance width of the banknote storage box, and the length in the width direction of the space where the dispensed banknotes are accumulated is greater than the exit width of the banknote storage box. Upon storage of banknotes sent from the depositing/dispensing port in the banknote storage box or upon accumulation of banknotes sent from the banknote storage box in the depositing/dispensing port, it is possible to prevent occurrence of trouble such as paper jam or poor posture. Further, the width direction regulation member, which forms the accumulation space and the depositing/dispensing space and which regulates the position in the banknote width direction, has a slope portion. Upon accumulation and upon movement of banknote from the accumulation space to the depositing/dispensing space, it is possible to set the position in the banknote width direction within the width of predetermined dispensing space and to dispense the banknotes in an orderly arrayed state.

Note that the present invention is not limited to the above embodiment, but various modifications can be made within the range of the subject matter of the present invention.

Modification 1: in the above embodiment, the pushout lever is provided in one position; however, the number of the pushout levers is not limited to one as long as it is possible to push out the paper sheets.

Modification 2: in the above embodiment, the two elements, the upper side plate and the lower side plate, are provided; however, one side plate may have the functions of the respective upper side plate and the lower side plate.

What is claimed is:

1. A cash automatic transaction device having a depositing/dispensing port configured to deposit/dispense banknotes, and a banknote storage box configured to store the deposited/dispensed banknotes, wherein the depositing/dispensing port has depositing/dispensing space to store the deposited/dispensed banknotes, and accumulation space in which the banknotes are accumulated upon dispensing, and the width of the depositing/dispensing space is smaller than an exit and entrance width of the storage box to an accumulation direction of the banknotes, while the width of the accumulation space is greater than the exit and entrance width of the storage box.

2. The cash automatic transaction device according to claim 1, wherein the accumulation space is covered with a shielding member upon banknote depositing by a user or banknote dispensing to the user.

3. The cash automatic transaction device according to claim 2, wherein the depositing/dispensing port has a guide member to guide the banknote to the accumulation space upon banknote accumulation, and the shielding member is the same as the guide member.

4. The cash automatic transaction device according to claim 1, wherein the depositing/dispensing space and the accumulation space are formed with a guide member to guide the banknote to the accumulation space upon banknote accumulation, and a width direction regulation member, in contact with an end of the accumulated banknote in the width direction as a vertical direction to a transfer direction, that regulates a position in the width direction, and the width direction regulation member is provided with a slope portion.

5. The cash automatic transaction device according to claim 4, wherein the depositing/dispensing port has an accumulation mechanism that accumulates the banknote in the depositing/dispensing port, the accumulation mechanism has a pushout member that pushes out the banknote by protruding, and the width direction regulation member, and the width direction regulation member provided in the accumulation mechanism has a slope portion.

6. The cash automatic transaction device according to claim 5, wherein the accumulation mechanism has a vane wheel to scrape out a lower end of the banknote, and the width direction regulation member having a plurality of slope portions, and the width direction regulation member is provided with the slope portions in positions where a first slope member is in contact with the banknote upon scraping out of the banknote with the vane wheel, and a second slope member is in contact with the banknote upon push-out of the banknote with the pushout member.

7. The cash automatic transaction device according to claim 6, wherein the accumulation space is on a device inner side from the depositing/dispensing space, and in the width direction regulation member, the first slope portion is formed on the accumulation space side, and the second slope portion is formed on the depositing/dispensing space side.

8. The cash automatic transaction device according to claim 4, wherein the depositing/dispensing port has the depositing/dispensing space and the accumulation space formed with a pressing mechanism that presses the banknote in a depth direction, the width direction regulation member, the guide member, and a floorboard that supports the banknotes.

9. The cash automatic transaction device according to claim 8, wherein the guide member is displaced to a first position as a banknote accumulation position, a second position as a position upon banknote separation, in the rear of the first position in the depth direction from the first position, and a third position as a banknote put-in or discharge position, in front of the first position in the depth direction, by operating the pressing mechanism in the depth direction.

* * * * *